US008789551B2

(12) United States Patent
Dotterweich

(10) Patent No.: US 8,789,551 B2
(45) Date of Patent: Jul. 29, 2014

(54) REINFORCED FRAME STRUCTURE

(75) Inventor: Marty Dotterweich, Escondido, CA (US)

(73) Assignee: Oliver Ma, Arcadia, CA (US)

( * ) Notice: Subject to any disclaimer, the term of this patent is extended or adjusted under 35 U.S.C. 154(b) by 376 days.

(21) Appl. No.: 12/870,728

(22) Filed: Aug. 27, 2010

(65) Prior Publication Data

US 2012/0048319 A1 Mar. 1, 2012

(51) Int. Cl.
*E04H 15/50* (2006.01)

(52) U.S. Cl.
USPC ..... 135/146; 135/145; 135/131; 135/151; 135/147

(58) Field of Classification Search
USPC ..... 135/122, 143, 131, 145, 146, 147, 151, 135/153, 154, 159, 120.3; 52/109, 645; 403/101, 102; 16/371, 374
See application file for complete search history.

(56) References Cited

U.S. PATENT DOCUMENTS

| | | | | | |
|---|---|---|---|---|---|
| 595,875 | A * | 12/1897 | Ernest | | 135/146 |
| 2,197,791 | A * | 4/1940 | Eddy | | 135/147 |
| 2,555,220 | A * | 5/1951 | Brown | | 135/139 |
| 2,962,034 | A | 11/1960 | Finlayson | | |
| 3,874,398 | A | 4/1975 | Hendrickson | | |
| D246,141 | S | 10/1977 | Mazur | | |
| 4,641,676 | A * | 2/1987 | Lynch | | 135/145 |
| 5,024,409 | A | 6/1991 | Bohnen | | |
| 5,035,253 | A | 7/1991 | Bortles | | |
| 6,431,193 | B2 | 8/2002 | Carter | | |
| 6,718,995 | B2 | 4/2004 | Dotterweich | | |
| 6,848,461 | B2 * | 2/2005 | Tsai | | 135/131 |
| 7,025,075 | B2 * | 4/2006 | Suh | | 135/145 |
| 7,367,348 | B2 * | 5/2008 | Tsai et al. | | 135/145 |
| 2002/0074031 | A1 * | 6/2002 | Morgante et al. | | 135/128 |
| 2004/0020526 | A1 * | 2/2004 | Deng | | 135/131 |
| 2010/0043856 | A1 * | 2/2010 | Park et al. | | 135/145 |
| 2011/0061702 | A1 * | 3/2011 | Lin | | 135/145 |

FOREIGN PATENT DOCUMENTS

| | | | |
|---|---|---|---|
| CN | 201531150 | U | 7/2010 |
| CN | 201695750 | U | 1/2011 |
| CN | 201695751 | U | 1/2011 |

OTHER PUBLICATIONS

United States Patent and Trademark Office, Office Action mailed Mar. 9, 2012 in U.S. Appl. No. 12/704,405, 8 pages.
WIPO, U.S. International Search Authority, International Search Report and Written Opinion mailed Jul. 13, 2011 in International Patent Application No. PCT/US2011/033627, 8 pages.

* cited by examiner

*Primary Examiner* — David R Dunn
*Assistant Examiner* — Danielle Jackson
(74) *Attorney, Agent, or Firm* — Inskeep IP Group, Inc.

(57) ABSTRACT

A frame structure having a truss comprising three longitudinal members the longitudinal alignment of which is facilitated by a stopper member that prevents a junction of the three members from pivoting beyond a desired angle.

13 Claims, 6 Drawing Sheets

REINFORCED FRAME STRUCTURE

FIELD OF THE INVENTION

The present invention relates to portable shelters and, more particularly, to reinforced frame structures that support portable shelters.

BACKGROUND OF THE INVENTION

The evolution of light-weight, easily erected and economical portable shelters has led to the increasing commercial and private use of these structures. Portable shelters typically employ a cloth or plastic material attached to a light-weight, highly foldable skeleton or frame structure. The cloth provides a roof and/or walls for the shelter, and the frame structure provides support for the cloth, for example, the frame structure includes legs to elevate the roof and a system of trusses to support the roof and to generally stabilize the shelter. The frame structure often incorporates a compound, scissor-like, arrangement of a light-weight, tubular material such as aluminum. In order to maximize the usable area under a shelter, the frame structure is often designed so that the roof is supported solely by legs positioned near the perimeter of the roof. Stated alternatively, shelters do not typically employ an interior supporting post or leg such as a leg or post positioned in the center of shelter. U.S. Pat. No. 4,641,676 to Lynch and U.S. Pat. No. 7,367,348 to Tsai et al., the contents of which are herein incorporated by reference, are examples of such portable shelters.

Unfortunately, the design objectives of internally unsupported roofs and light-weight and foldable frame structures, often results in portable shelters that are unstable in wind and that suffer from sagging or collapsing roofs and peaks. What is needed in the art is a frame structure for a portable shelter that provides increased stability and prevents sagging and collapsing while maintaining the design objectives of maximizing usable space, foldability, and light-weight.

OBJECTS AND SUMMARY OF THE INVENTION

The object of the present invention is to provide a frame structure for portable shelters that has enhanced stability and resists sagging and collapse. A further objective of the present invention is to achieve the above objectives without sacrificing the usable space under the portable shelter and without adversely affecting the foldability and weight of the portable shelter. These objectives are achieved by employing a frame structure having a peak truss comprising three longitudinal members the longitudinal alignment of which is facilitated by a stopper member that prevents a junction of the three members from pivoting beyond a desired angle.

DESCRIPTION OF EMBODIMENTS

Figure 1A:
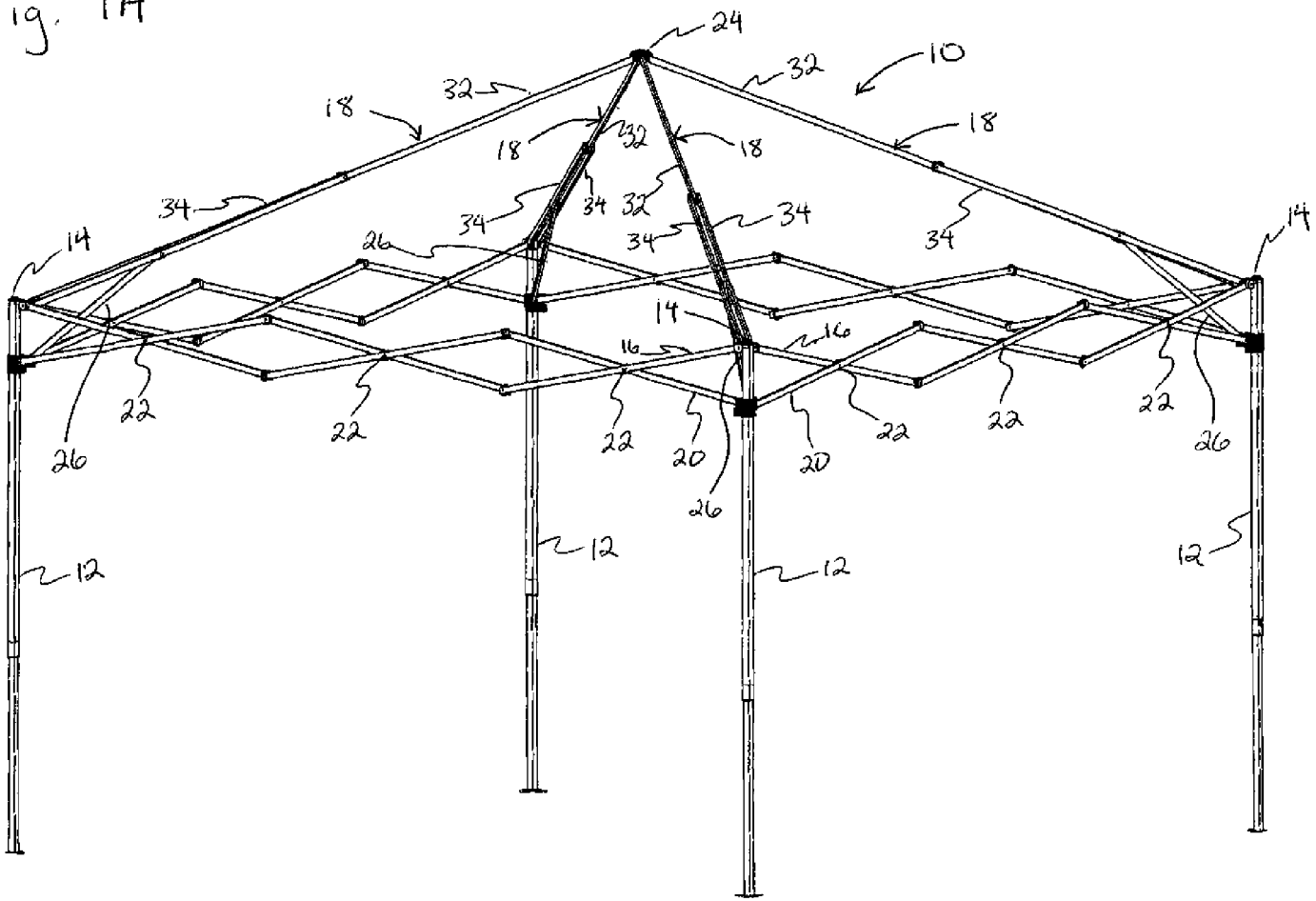
FIG. 1A is a perspective view of a frame structure for a portable shelter according to one embodiment of the present invention.

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements.

The frame structure for the present portable shelter provides increased stability and prevents sagging and collapsing of the shelter while maintaining the design objectives of maximizing usable space, foldability, and light-weight.

Figure 1B:
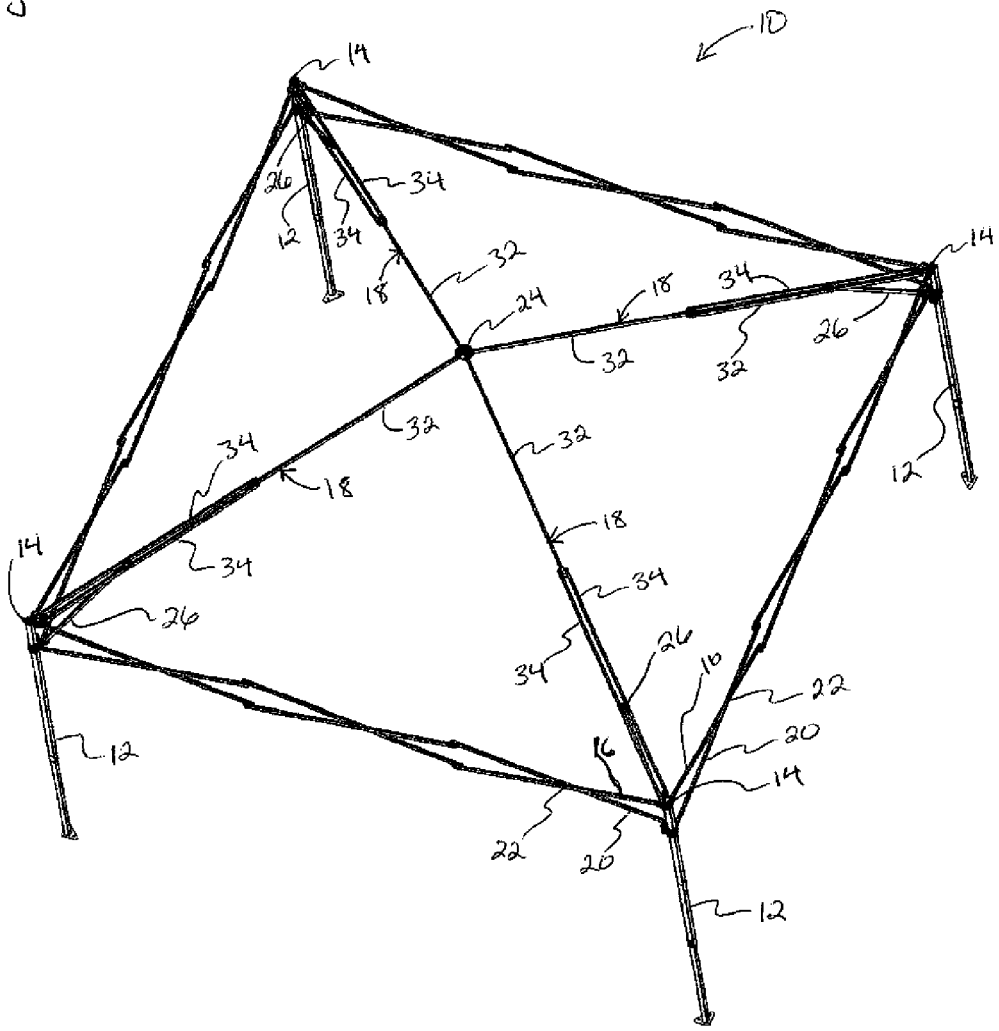
FIG. 1B is a perspective view of a frame structure for a portable shelter according to one embodiment of the present invention.
Figure 2:
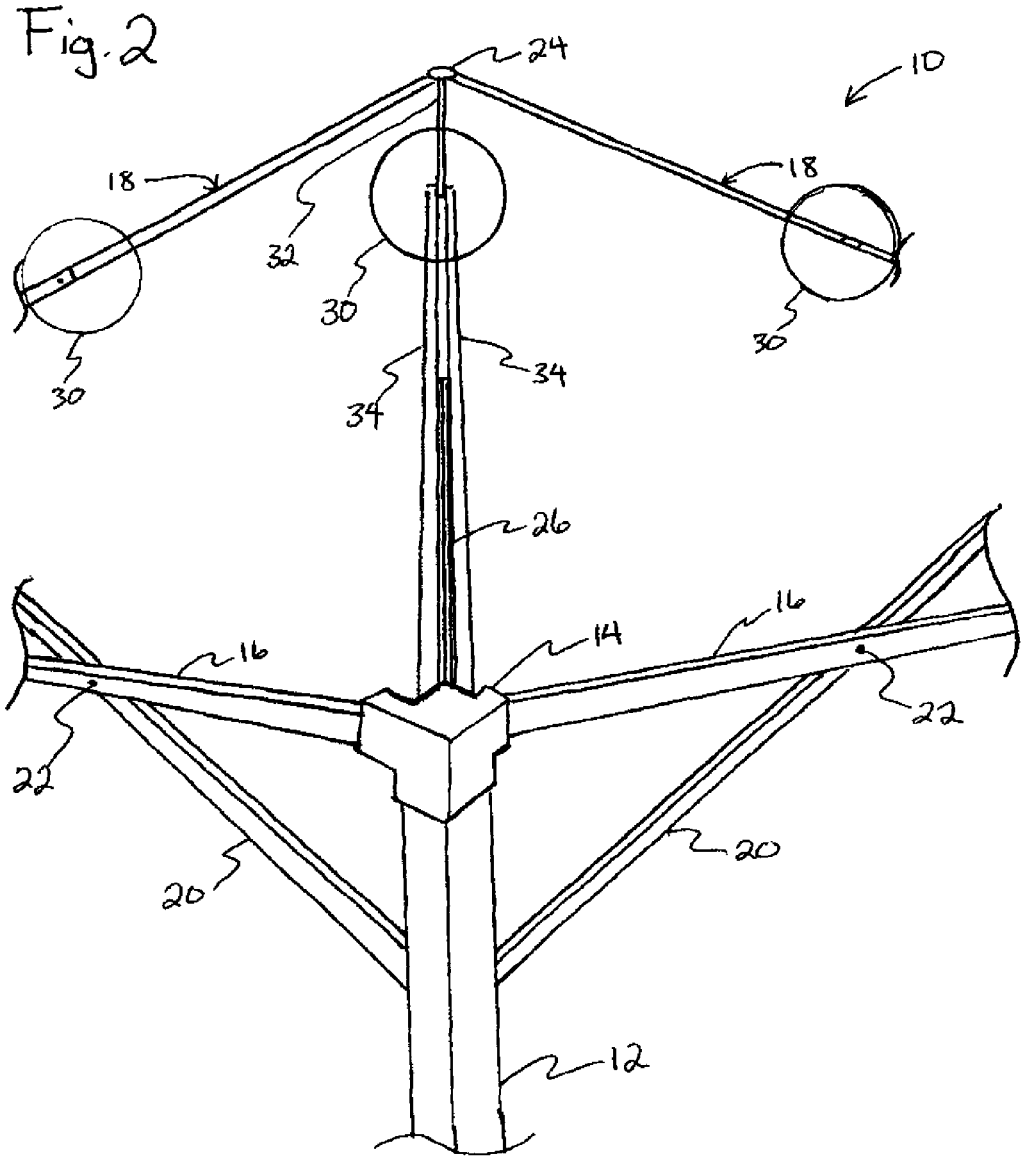
FIG. 2 is a perspective view of a portion of a frame structure according to one embodiment of the present invention.
Figure 6:
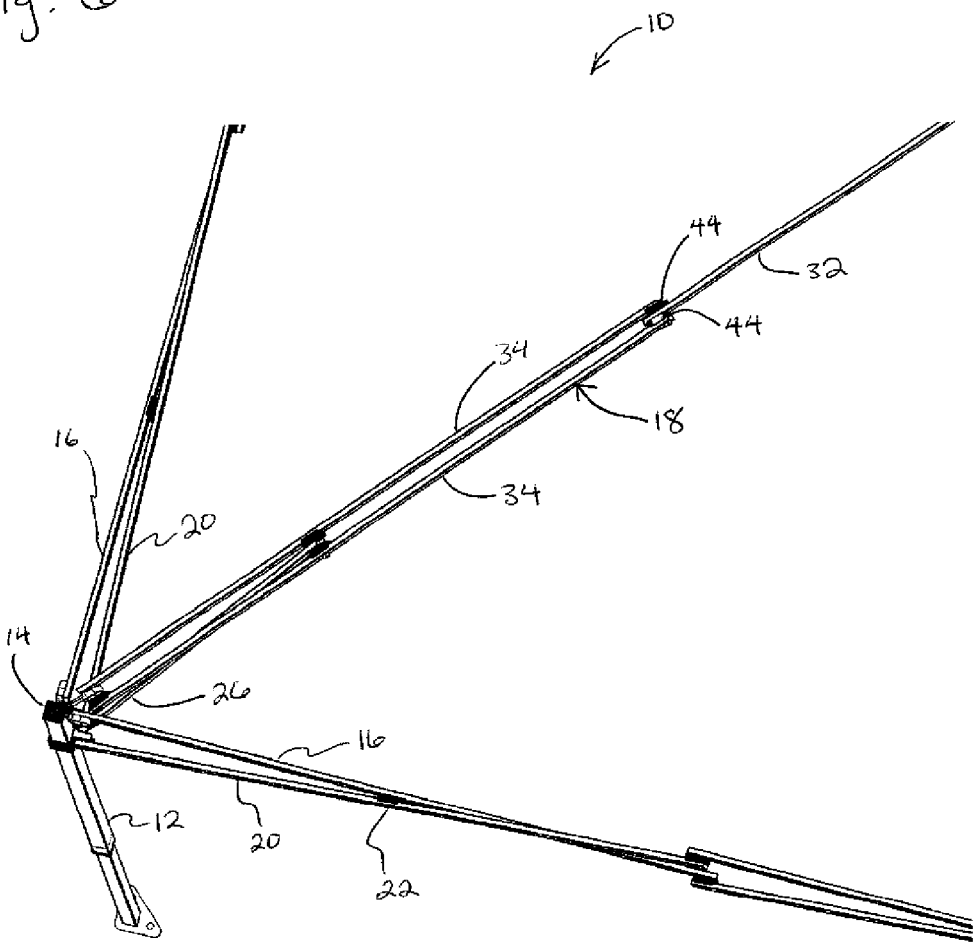
FIG. 6 is a perspective view of a portion of a frame structure according to one embodiment of the present invention.

FIGS. 1A and 1B show a reinforced frame structure according to one embodiment of the present invention, and FIGS. 2 and 6 show partial views of reinforced frame structures according to certain embodiments of the present invention. As shown, frame 10 employs legs 12 which extend upward from the ground to a corner junction 14. The corner junction 14 attaches primary side trusses 16 and peak trusses 18 to the leg 12. Secondary side trusses 20 are attached at one end to the leg 12 at a point between the end of the leg 12 resting upon the ground and the corner junction 14 and are attached at an intermediary point 22 along a length of the primary side truss 16. Each of the peak trusses 18 are attached to one another at a peak junction 24. A truss support 26 may also be employed to extend from the peak truss 18 to the leg 12 at a point between the end of the leg 12 resting upon the ground and the corner junction 14 so as to vertically support the peak truss 18.

When a portable shelter according to the present invention is in an open, expanded state, the peak junction 24 will be positioned in a location in the approximate center of the horizontal area occupied by the shelter and elevated above the height of the top of the legs 12. In this manner, the peak junction 24 forms a peak or high-point of the roof of the frame 10.

Of particular importance to achieving the objectives of providing a frame structure having increased stability while also preventing sagging and collapsing of the shelter roof is the configuration of the peak trusses 18. As shown in FIG. 2, a first end of a single truss 32 is attached to the peak junction 24. A second end of the single truss 32 is interposed between the members of a truss pair 34 and attached to the truss pair by fastener 38, shown in FIGS. 3-5. The opposite end of the truss pair 34 is attached to the corner junction 14.

Figure 3:
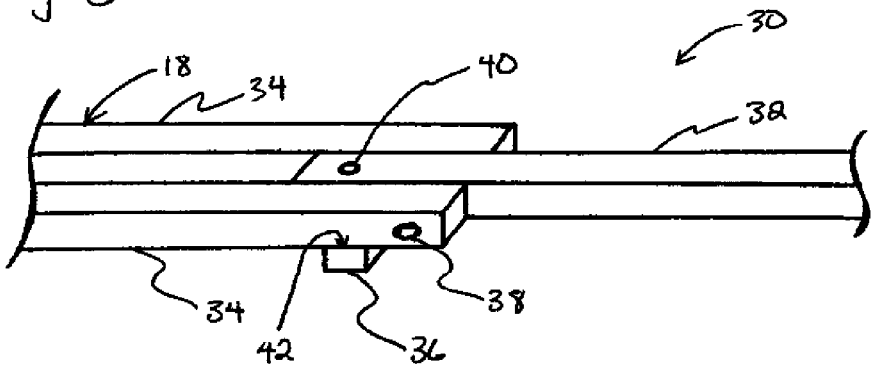
FIG. 3 is a magnified, perspective view of the truss junction 30 shown in FIG. 2.
Figure 4:
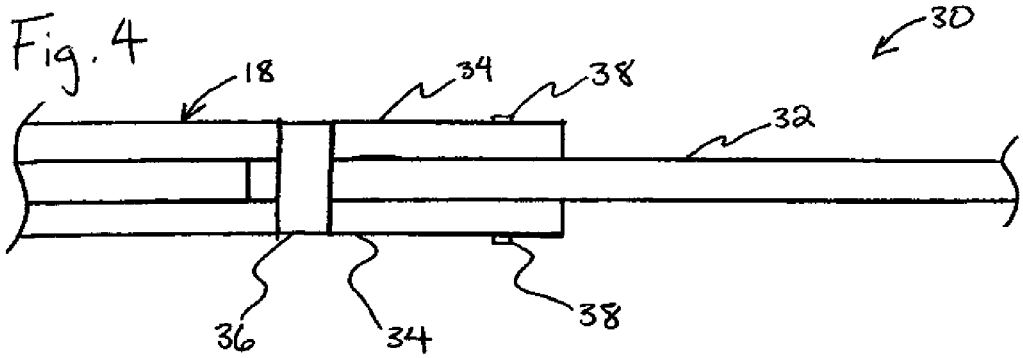
FIG. 4 is a magnified, bottom view of the truss junction 30 shown in FIG. 2.
Figure 5:
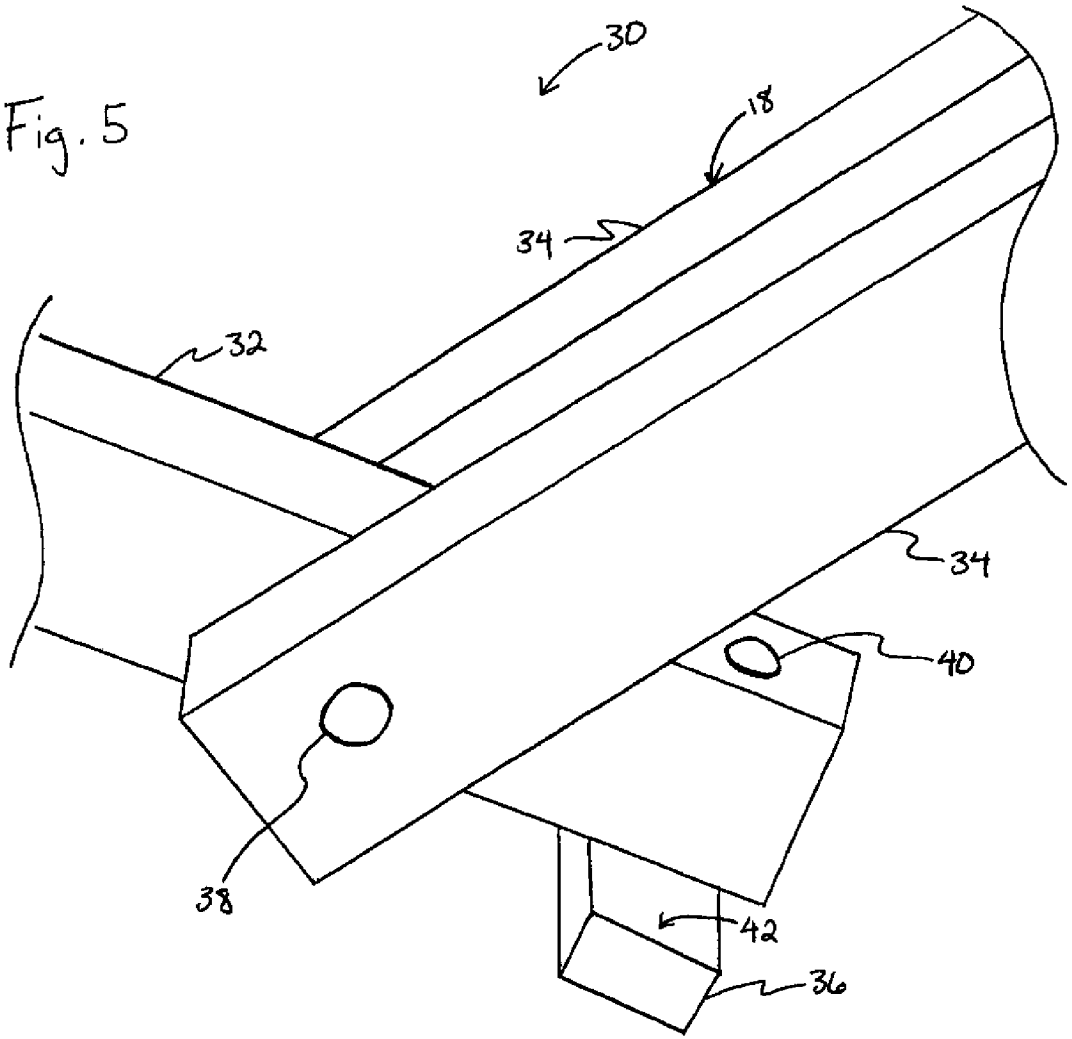
FIG. 5 is a magnified, perspective view of the truss junction 30 shown in FIG. 2.

FIGS. 3 and 4 show the configuration of the truss junction 30 when the frame structure 10 is in a fully expanded or open state. Note that the single truss 32 and the truss pair 34 are oriented longitudinally along a common axis when in the open state. FIG. 5 shows the configuration of the truss junction 30 when the frame structure is in an intermediate or closed state. In a non-open state, the single truss 32 and the truss pair 34 are not oriented longitudinally along a common axis. As shown best in FIG. 5, a stopper fastener 40 attaches a stopper 36 to the single truss 32. When transforming the frame structure 10 from the closed to the open, expanded state, the stopper 36 provides a surface 42 against which the truss pair 34 will contact and prevent further rotation once the frame structure 10 has been expanded to the open state. Accordingly, the stopper 36 assists in longitudinally aligning the single truss 32 and the members of the truss pair 34 when the frame structure is in the open state. Once aligned, the peak truss 18 provides a three member truss junction 30, the single truss 32 interposed between the two members of the truss pair 34, that has enhanced lateral rigidity to resist wind and other lateral forces. The three member truss junction 30 also provides enhanced rigidity against sagging and collapsing due to vertical loads such as rain.

While the stopper 36 has been described as being attached to the single truss 32, it will be understood by those of ordinary skill in the art that the stopper may also be attached to the truss pair 34 in order to achieve the same objectives. For example, as shown in FIG. 5, the fastener 38 attaches the approximate ends of the truss pair 34 to the single truss 32 at a point proximal to the end of the single truss 32. This design allows for a significant overlap between the single truss 32 and the truss pair 34, thereby providing a three member truss junction 30. In an alternative embodiment, the fastener 38 attaches the approximate ends of the single truss 32 to the truss pair 34 at a point proximal to the end of the truss pair 34. In this embodiment, the stopper 36 is attached to the approximate ends of the truss pair 34.

One of skill in the art will also recognize that the frame structure 10 of the present invention may be constructed from a variety of materials known in the art to facilitate lightweight designs and foldability, including tubular or solid aluminum. For example, FIG. 6 shows an embodiment of the present invention differing from that shown in FIGS. 2 through 5 in that the truss 32 and the truss pair 34 employ a narrower shape fabricated from a solid material. In order to provide the desired spacing between the truss pair 34 and the single truss 32, spacers 44 are employed between the trusses such that the fastener 38 passes through the single truss 32, the truss pair 34, and two spacers 44. One spacer 44 being interposed on each side of the single truss 32. The embodiment provides for easier, more compact folding of the frame structure 10 due to the reduced cross-sectional shape of the truss members.

The fastener 38 and the stopper fastener 40 may employ a bolt, screw, pin, or other suitable means for attachment known in the art.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A portable shelter comprising:

a frame structure and a cover enclosing at least a top portion of the frame structure, the frame structure comprising:

a plurality of elongated, vertical supports:

a pair of first truss members having proximal end portions attached directly to one of the plurality of elongated, vertical supports;

a second truss member having a proximal end portion interposed between the pair of first truss members and attached thereto and a distal end portion attached directly to a peak junction; and a stopper attached to the second truss member such that vertical rotation of the pair of first truss members and the second truss member relative to one another is limited.

2. The portable shelter of claim 1 wherein the pair of first truss members is supported by a truss support member attached to one of the plurality of elongated, vertical supports at a point independent of a point at which the pair of first truss members attach to said one of the plurality of elongated supports.

3. The portable shelter of claim 1 wherein the stopper is attached to the second truss member approximate to an end of the second truss member.

4. The portable shelter of claim 1 wherein the stopper is attached to the second truss member such that a longitudinal axis of the stopper is approximately perpendicular to a longitudinal axis of the second truss member.

5. The portable shelter of claim 1 wherein the individual members of the pair of first truss members and the second truss member have a substantially identical cross-sectional shape.

6. A structure for reinforcing a frame for a portable shelter comprising:

a pair of first truss members having first end portions pivotally attached to a leg;

a second truss member having a first end portion interposed between second end portions of the pair of first truss members and rotatably attached thereto, a second end portion of the second truss member attached directly to a peak junction; and a stopper attached to one of said pair of first truss members or said second truss member that limits rotation of the pair of first truss members and second truss member relative to one another.

7. The structure of claim 6 wherein the rotation of the pair of first truss members and the second truss member relative to one another is vertical.

8. The structure of claim 6 wherein the stopper is attached to the second truss member such that a longitudinal axis of the stopper is approximately perpendicular to a longitudinal axis of the second truss member.

9. The structure of claim 6 wherein the stopper is attached to the pair of first truss members such that a longitudinal axis of the stopper is approximately perpendicular to a longitudinal axis of the pair of first truss members.

10. A method for enhancing the stability of a portable shelter comprising the steps of:

interposing a proximal end portion of a primary truss member between distal end portions of a pair of secondary truss members;

pivotally attaching the proximal end portion of the primary truss member to the distal end portions of the pair of secondary truss members;

limiting pivotal rotation of the primary truss member and the pair of secondary truss members relative to one another;

attaching proximal end portions of the pair of secondary truss members to a leg; and attaching a distal end portion of the primary truss member directly to a peak junction.

11. The method of claim 10 wherein the step of limiting pivotal rotation of the primary truss member and the pair of secondary truss members relative to one another comprises attaching a stopper to the primary truss member.

12. The method of claim 10 wherein the step of limiting pivotal rotation of the primary truss member and the pair of secondary truss members relative to one another comprises attaching a stopper to the pair of secondary truss members.

13. The method of 10 wherein the step of limiting pivotal rotation of the primary truss member and pair of secondary truss members relative to one another comprises orienting a longitudinal axis of a stopper approximately perpendicular to a longitudinal axis of the primary truss member.

* * * * *